US011692565B2

(12) United States Patent
Baldwin et al.

(10) Patent No.: US 11,692,565 B2
(45) Date of Patent: Jul. 4, 2023

(54) FLOW CONTROL INSERT FOR AN AGENT DISTRIBUTION SYSTEM

(71) Applicant: Kidde Technologies, Inc., Wilson, NC (US)

(72) Inventors: Eli Baldwin, Knightdale, NC (US); Mark P. Fazzio, Wilson, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 10 days.

(21) Appl. No.: 17/399,705

(22) Filed: Aug. 11, 2021

(65) Prior Publication Data

US 2023/0051286 A1 Feb. 16, 2023

(51) Int. Cl.
*F15D 1/02* (2006.01)
*F15D 1/04* (2006.01)
*F15D 1/14* (2006.01)

(52) U.S. Cl.
CPC ..... *F15D 1/04* (2013.01); *F15D 1/14* (2013.01)

(58) Field of Classification Search
CPC ..... F15D 1/04; F15D 1/14
USPC ..... 138/37, 39
See application file for complete search history.

(56) References Cited

U.S. PATENT DOCUMENTS 253,908 A 2/1882 Brady
742,409 A * 10/1903 Gallaher ..... F16L 27/12 285/133.11
797,253 A 8/1905 Banister
1,021,766 A * 4/1912 Ferguson ..... B65G 47/72 138/37
1,086,143 A 2/1914 Davidson
1,487,845 A * 3/1924 Galusha ..... C10J 3/80 138/37
1,621,022 A 3/1927 Merchen
1,946,945 A * 2/1934 Mekler ..... F16L 43/005 55/DIG. 37
2,327,449 A * 8/1943 Parker ..... F16L 41/005 138/37
2,380,839 A * 7/1945 William ..... G05D 23/128 138/37
2,756,731 A * 7/1956 Wille ..... F02B 25/00 123/65 PD
3,080,884 A 3/1963 Nelson et al.
3,363,616 A * 1/1968 Baumgarten ..... F01M 11/04 138/41

(Continued)

FOREIGN PATENT DOCUMENTS

CA 1161335 1/1984

OTHER PUBLICATIONS

European Search Report for Application No. 22187720.2, dated Dec. 13, 2022, 11 pages.

*Primary Examiner* — James F Hook
(74) *Attorney, Agent, or Firm* — Cantor Colburn LLP

(57) ABSTRACT

A flow control insert includes a main body that is shaped as a cylinder, is hollow, and includes an opening at a first end and at a second end, opposite the first end, along an axial length of the cylinder. An outer surface of the main body includes threading to screw into complementary threading on an inner surface of a pipe configured to flow an agent. The flow control insert also includes a diverter within the main body or extending from the first end of the main body. The diverter controls a mass split of the agent or flow energy of the agent flowing in the pipe.

7 Claims, 6 Drawing Sheets

(56) References Cited

U.S. PATENT DOCUMENTS

| | | | | |
|---|---|---|---|---|
| 4,248,269 | A * | 2/1981 | Mercier | F16L 55/053 138/30 |
| 4,487,227 | A * | 12/1984 | Meissner | B01D 29/54 138/42 |
| 4,524,616 | A | 6/1985 | Drexel et al. | |
| 4,524,835 | A * | 6/1985 | Mingrone | A62C 3/006 169/65 |
| 5,113,838 | A * | 5/1992 | Kim | F02M 29/06 123/593 |
| 6,056,001 | A | 5/2000 | Boyles et al. | |
| 8,113,313 | B2 * | 2/2012 | Lynch | F16L 55/033 137/13 |
| 9,016,392 | B2 | 4/2015 | Khalil et al. | |
| 2003/0070718 | A1 * | 4/2003 | Benham | F15D 1/14 137/861 |
| 2003/0192339 | A1 | 10/2003 | Macbain | |
| 2005/0109025 | A1 * | 5/2005 | Kenyon | F16L 41/084 138/37 |
| 2007/0158476 | A1 | 7/2007 | Laidler et al. | |

* cited by examiner

FLOW CONTROL INSERT FOR AN AGENT DISTRIBUTION SYSTEM

BACKGROUND

Exemplary embodiments pertain to the art of agent distribution and, in particular, to a flow control insert for an agent distribution system.

The distribution system that supplies an agent into a space can affect the concentration of the agent in different areas of the space and, consequently, the effectiveness of the agent in the space. For example, in a fire suppression system, optimal distribution of a fire suppression agent ensures a sufficient concentration of the agent in different areas. At the same time, an ideal distribution system would require a minimal total mass of the fire suppression agent.

BRIEF DESCRIPTION

In one embodiment, a flow control insert includes a main body that is shaped as a cylinder, is hollow, and includes an opening at a first end and at a second end, opposite the first end, along an axial length of the cylinder. An outer surface of the main body includes threading to screw into complementary threading on an inner surface of a pipe configured to flow an agent. The flow control insert also includes a diverter within the main body or extending from the first end of the main body. The diverter controls a mass split of the agent or flow energy of the agent flowing in the pipe.

Additionally or alternatively, the diverter is shaped as an extension from a portion of the first end of the main body with a first diverter end contacting the portion of the first end of the main body and a second diverter end, opposite the first diverter end, and the diverter is curved such that the second diverter end is closer to a radial center of the main body than the first diverter end.

Additionally or alternatively, the main body includes a hole between the first end and the second end, and a longest portion of the hole extends over a range of axial positions along the axial length of the cylinder.

Additionally or alternatively, the diverter is within the main body, the diverter extends from an inner surface of the main body, the diverter is located opposite the hole along a radial length of the cylinder, and a center of the diverter is at a position that is within the range of axial positions along the axial length of the cylinder.

Additionally or alternatively, the diverter is shaped such that the center of the diverter is closer to a radial center of the main body than other portions of the diverter and the diverter includes a slope on both sides of the center of the diverter from the center of the diverter to the inner surface of the main body.

In another embodiment, an agent distribution system includes a network of pipes to facilitate a flow of the agent from an inlet to two or more outlets. The agent distribution system also includes a flow control insert with a main body that is shaped as a cylinder, is hollow, and includes an opening at a first end and at a second end, opposite the first end, along an axial length of the cylinder. An outer surface of the main body includes threading to screw into complementary threading on an inner surface of a pipe among the network of pipes. The flow control insert also includes a diverter within the main body or extending from the first end of the main body. The diverter controls a mass split of the agent or flow energy of the agent flowing in the pipe.

Additionally or alternatively, the diverter is shaped as an extension from a portion of the first end of the main body with a first diverter end contacting the portion of the first end of the main body and a second diverter end, opposite the first diverter end, and the diverter is curved such that the second diverter end is closer to a radial center of the main body than the first diverter end.

Additionally or alternatively, the network of pipes includes a partial-split junction at which the flow of the agent in a first pipe among the network of pipes is split between a remainder of the first pipe and a side pipe that forms an angle with the first pipe.

Additionally or alternatively, the diverter is threaded within the side pipe based on the network of pipes including the partial-split junction, and the second diverter end controllably extends into the first pipe.

Additionally or alternatively, the network of pipes includes an acute full-split junction at which the flow of the agent in a first pipe is split between a first angled pipe and a second angled pipe, a first angle between the first angled pipe and the first pipe and a second angle between the second angled pipe and the first pipe being greater than 0 degrees and less than 90 degrees.

Additionally or alternatively, the diverter is threaded within the first angled pipe based on the network of pipes including the acute full-split junction, and the second diverter end controllably extends into the acute full-split junction.

Additionally or alternatively, the main body includes a hole between the first end and the second end, a longest portion of the hole extends over a range of axial positions along the axial length of the cylinder.

Additionally or alternatively, the diverter is within the main body, the diverter extends from an inner surface of the main body, the diverter is located opposite the hole along a radial length of the cylinder, and a center of the diverter is at a position that is within the range of axial positions along the axial length of the cylinder.

Additionally or alternatively, the diverter is shaped such that the center of the diverter is closer to a radial center of the main body than other portions of the diverter and the diverter includes a slope on both sides of the center of the diverter from the center of the diverter to the inner surface of the main body.

Additionally or alternatively, the network of pipes includes an obtuse full-split junction at which the flow of the agent in a first pipe is split into a second pipe and a third pipe, a first angle between the second pipe and the first pipe and a second angle between the third pipe and the first pipe being at least 90 degrees and less than 180 degrees, the flow control insert is configured to be threaded into the inner surface of the second pipe and the third pipe, and the hole in the main body of the flow control insert facilitates the flow of the agent from the first pipe into the obtuse full-split junction.

In yet another embodiment, a method of fabricating a flow control insert, the method comprising fabricating a main body to be shaped as a cylinder, to be hollow, and to include an opening at a first end and at a second end, opposite the first end, along an axial length of the cylinder and including threading on an outer surface of the main body. The threading screws into complementary threading on an inner surface of a pipe facilitates flow of an agent. The method also includes forming a diverter within the main body or to extend from the first end of the main body. The forming the diverter includes configuring the diverter to control a mass split of the agent or flow energy of the agent flowing in the pipe.

Additionally or alternatively, the forming the diverter includes shaping the diverter as an extension from a portion of the first end of the main body with a first diverter end contacting the portion of the first end of the main body and a second diverter end, opposite the first diverter end, and curving the diverter such that the second diverter end is closer to a radial center of the main body than the first diverter end.

Additionally or alternatively, the fabricating the main body includes forming a hole between the first end and the second end, a longest portion of the hole extending over a range of axial positions along the axial length of the cylinder.

Additionally or alternatively, the forming the diverter includes locating the diverter within the main body, the diverter extending from an inner surface of the main body, locating the diverter opposite the hole along a radial length of the cylinder, and positioning a center of the diverter within the range of axial positions along the axial length of the cylinder.

Additionally or alternatively, the forming the diverter includes shaping the diverter such that the center of the diverter is closer to a radial center of the main body than other portions of the diverter and including a slope on both sides of the center of the diverter from the center of the diverter to the inner surface of the main body.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

As previously noted, it is desirable for a distribution system of an agent to ensure sufficient concentration of the agent in different areas while minimizing a total mass of the agent that needs to be distributed. The network of pipes or tubing (i.e., the plumbing) of a distribution system typically includes tee and wye junctions to split the flow of the agent into multiple branches that deliver the agent to different areas. Predicting the mass split that is achieved with these junctions can be challenging, especially when the system and/or junction includes asymmetry. This challenge can be increased when dealing with a particle-based agent or a fluid agent that undergoes phase change from liquid to vapor within the network. As a result, finalizing the design of a distribution system is difficult without employing an iterative process that includes designing the network, fabricating it, conducting concentration testing on the fabrication result, and then redesigning as needed. Because such a process would be inefficient in terms of both time and cost, a base network is fabricated and adjustments to flow may be made after the fact. Prior approaches to adjustment include the use of flow splitters or diverters whose position at a junction of pipes may be adjusted according to an external screw position.

Embodiments of the systems and methods detailed herein relate to a flow control insert for an agent distribution system. A fire suppression system in an aircraft is an exemplary agent distribution system according to one or more embodiments. As detailed, one or more flow control inserts may be added at one or more junctions of the plumbing. The flow control inserts include a diverter to facilitate tuning the mass split and flow energy at the junctions. For a given distribution system in a given space, a specific set of flow control inserts may be selected (e.g., based on concentration testing of already-fabricated plumbing) and threaded or otherwise affixed within the plumbing for use. The positioning of the flow control inserts via the threading, selection of the particular flow control inserts, or both may be used to control the flow of the agent in the agent distribution system.

Figure 1:
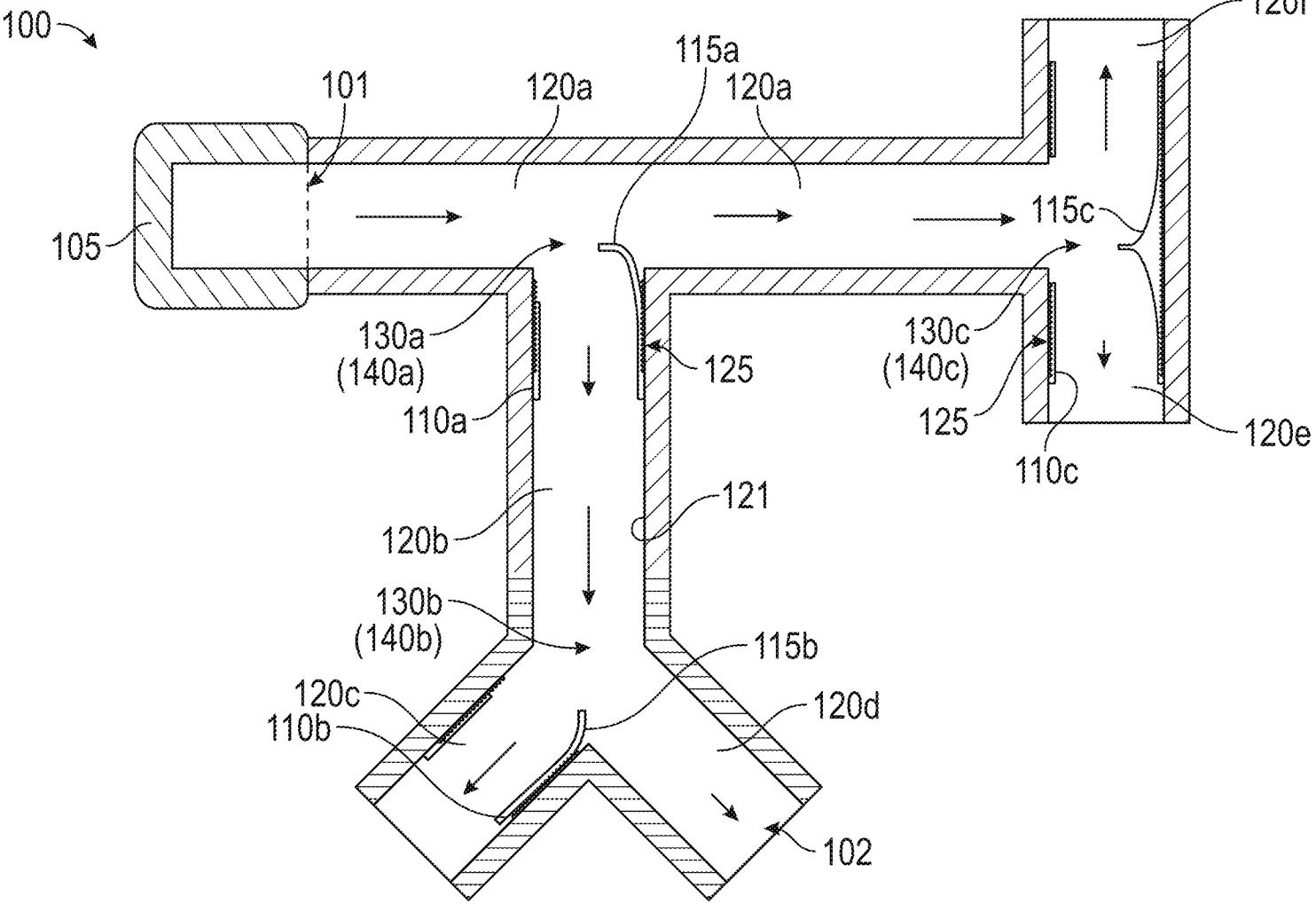
FIG. 1 is a cross-sectional view of an exemplary agent distribution system with flow control inserts according to one or more embodiments.

FIG. 1 is a cross-sectional view of an exemplary agent distribution system 100 with flow control inserts 110 according to one or more embodiments. The agent distribution system 110 includes an inlet 101 where the agent 105 may be input to the network of pipes 120. The agent distribution system 110 may include multiple outlets 102 from which the agent 105 is released. For example, the agent 105 may be a particle-based fire suppression agent that is distributed to the multiple outlets 102 within an aircraft or other space. The network of pipes 120 that are part of the agent distribution system 110 may include junctions 130 at which the flow of agent 105 is split. For example, a side-tee junction 130*a*, wye junction 130*b*, and bull tee junction 130*c* are shown. At the side-tee junction 130*a*, some of the flow of the agent 105 continues in the pipe 120*a* (following the side-tee junction 130*a*) and some of the flow is split to a pipe 120*b* that is perpendicular to the pipe 120*a*, as shown. At the wye junction 130*b*, the flow of agent 105 in the pipe 120*b* is split between angled pipes 120*c* and 120*d*. At the bull tee junction 130*c*, the flow in the pipe 120*a* is split into two pipes 120*e*, 120*f* that are both perpendicular to the pipe 120*a* and which have opposite directions for the flow of the agent 105, as shown.

While a side-tee junction 130*a*, wye junction 130*b*, and bull tee junction 130*c* are shown and discussed for explanatory purposes, the flow control inserts 110, according to one or more embodiments, are not limited to controlling the flow in only these particular junctions 130. More generally, the side-tee junction 130*a* is a partial-split junction 140*a*, because the pipe 120*b* may be at an angle other than 90 degrees relative to the pipe 120*a*. More generally, the wye junction 130*b* is an acute full-split junction 140*b*, because the flow in pipe 120*b* is completely split into pipes 120*c* and

120*d*, and each of the pipes 120*c* and 120*d* may form an angle with the pipe 120*b* that is greater than 0 degrees and less than 90 degrees. The angle of each of the pipes 120*c* and 120*d* relative to pipe 120*b* need not be the same (e.g., pipe 120*c* may split 30 degrees to the right relative to the flow in the pipe 120*b* while the pipe 120*d* may split 70 degrees to the left relative to the flow in the pipe 120*b*). In addition, the bull tee junction 130*c* is, more generally, an obtuse full-split junction 140*c*, because the flow in pipe 120*a* is completely split into pipes 120*e* and 120*f*, and each of the pipes 120*e* and 120*f* may form an angle with the pipe 120*a* that is at least 90 and less than 180 degrees. The angle of each of the pipes 120*e* and 120*f* relative to pipe 120*a* need not be the same (e.g., pipe 120*e* may split 90 degrees to the right relative to the flow in the pipe 120*a*, as shown, while the pipe 120*f* may split 110 degrees to the left relative to the flow in the pipe 120*a*).

According to one or more embodiments, the flow at one or more of the junctions 140 is controlled by a flow control insert 110. Exemplary embodiments of the flow control inserts 110 are further discussed with reference to FIGS. 2-6. Generally, FIG. 1 shows that some of the pipes 120 include threading 125 at the inner surface 121. This threading is complementary to threading 225 (FIGS. 2, 7) on the outer surface 220 (FIGS. 2, 7) of the flow control inserts 110. As such, the flow control inserts 110 may be affixed within the pipes 120. The flow control inserts 110 are shown to include a diverter 115. For example, the flow control insert 110*a* at the side-tee junction 130*a* is threaded into the pipe 120*b* and includes a curved diverter 115*a* that that extends into the pipe 120*a*. The flow control insert 110*b* at the wye junction 130*b* is threaded into the pipe 120*c* and the curved diverter 115*b* extends into the wye junction 130*b*. The flow control insert 110*c* is threaded into both the pipes 120*e*, 120*f* that are perpendicular to the incoming pipe 120*a*. The diverter 115*c* is further discussed with reference to FIGS. 8 and 9.

At a given junction 140, a particular flow control insert 110 may be selected to control the mass split of the agent 105 and the flow energy required according to concentration testing of the network of pipes 120. That is, prior to inserting any flow control inserts 110, the concentration of agent 105 at each outlet 102 of the agent distribution system 100 may be determined. Based on this analysis, one among several options of flow control inserts 110 may be selected for inclusion at one or more junctions 130. For example, if the concentration of agent 105 at outlets 102 that are fed by pipe 120*b* is less than the concentration of agent 105 at outlets 102 fed by pipe 120*a*, then the flow control insert 110*a* at the side-tee junction 130*a* may be selected, from among available flow control inserts 110, to increase the concentration of agent 105 in pipe 120*b*. This selection may involve choosing a flow control insert 110 with a diverter 115 that extends further into the pipe 120*a* (i.e., the flow control insert 110 with the longest diverter 115 may be selected as the flow control insert 110*a* whose diverter 115*a* extends into the pipe 120*a*) in order to split more of the mass of the agent 105 into the pipe 120*b*. The curved shape of the diverter 115*a* facilitates maintaining flow energy of the agent 105, which would be dissipated by a straight diverter 115*a*.

Figure 2:
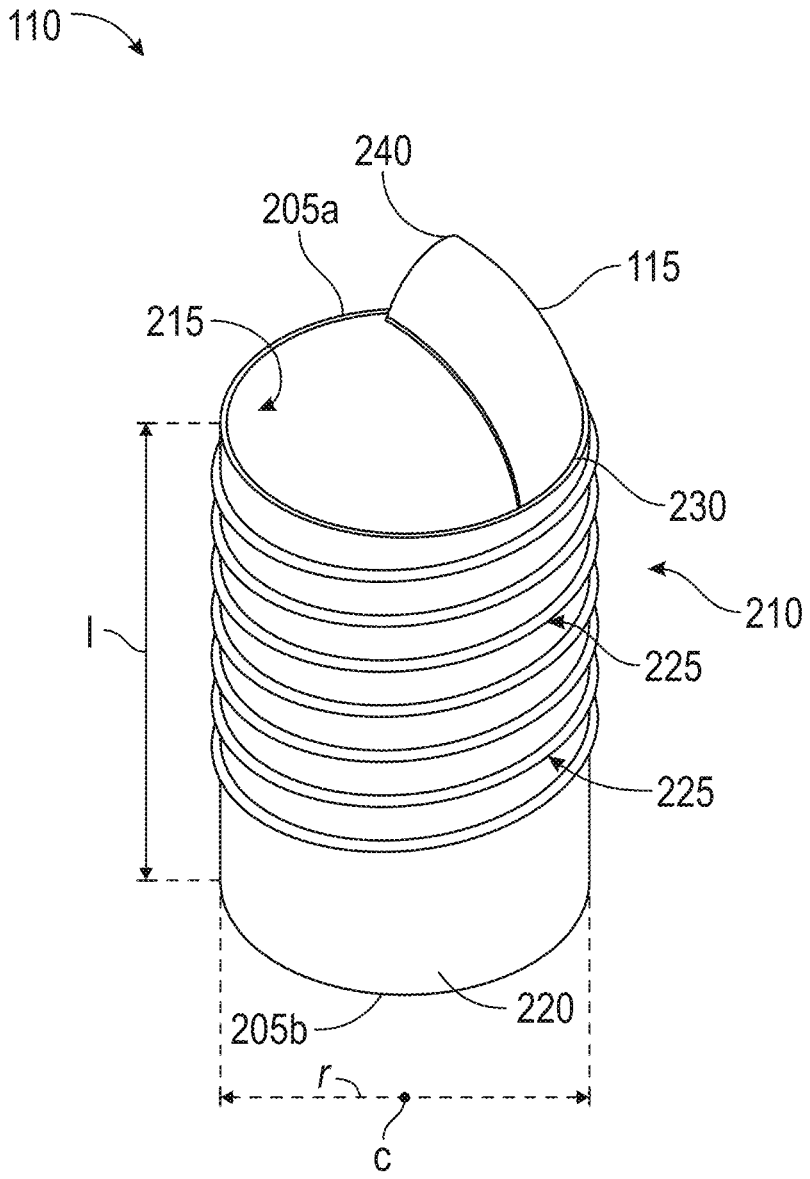
FIG. 2 shows a flow control insert according to one or more embodiments.

FIG. 2 shows a flow control insert 110 according to one or more embodiments. The exemplary embodiment shows the type of flow control insert 110*a*, 11*b* indicated at the side-tee junction 130*a* and wye junction 130*b* in FIG. 1. This type of flow control insert 110*a*, 110*b* may be used at any partial-split junction 140*a* or acute full-split junction 140*b*. The diverter 115 extends from a main body 210. This main body 210 has a cylindrical shape, is hollow, and extends from one end 205*a* to another, opposite end 205*b* along the axial length 1. The radial length r is also indicated. The inner surface 215 and outer surface 220 of the main body 210 (i.e., cylinder) are indicated. The outer surface 220 includes threading 225. This threading 225 is complementary to the threading 125 at the inner surface 121 of some pipes 120, as shown in FIG. 1.

The diverter 115, according to the exemplary embodiment of the flow control insert 110 shown in FIG. 2, is a rigid extension from the main body 210 at one end 205*a* of the cylinder. Specifically, one end 230 of the diverter 115 is in contact with the end 205*a* of the main body 210 while the other end 240 of the diverter 115 extends away from the main body 210. The diverter 115 has a curved shape such that the other end 240 is closer to a radial center c of the main body 210 than the one end 230. The length of the diverter 115 (i.e., the distance between the ends 230, 240) and the curvature may be different for different flow control inserts 110. As discussed with reference to FIGS. 3-6, the particular flow control insert 110 that is selected for a particular side-tee junction 130*a* or wye junction 130*b* may be based on the length and/or curvature of the diverter 115 of available flow control inserts 110 and on results of the concentration testing on the pipes 120. Additionally or alternately, the positioning of the flow control insert 110 (e.g., how much it is threaded) may be based on results of the concentration testing.

Figure 4:
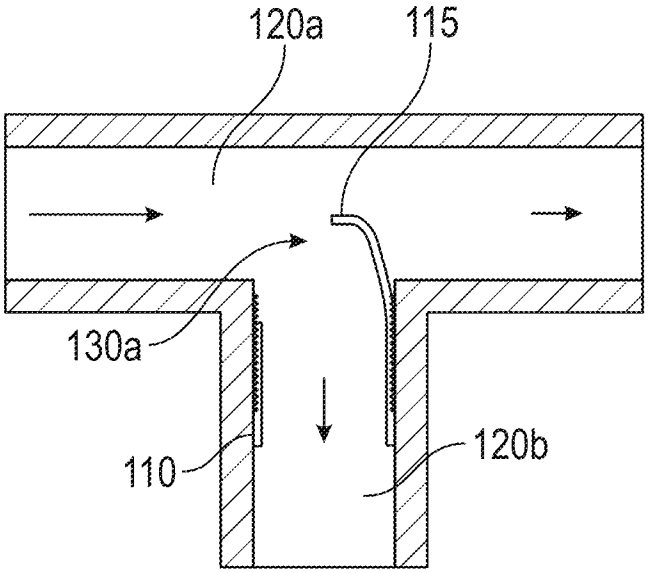
FIG. 4 is a cross-sectional view of the flow control insert shown in FIG. 3 in a different position.
Figure 3:
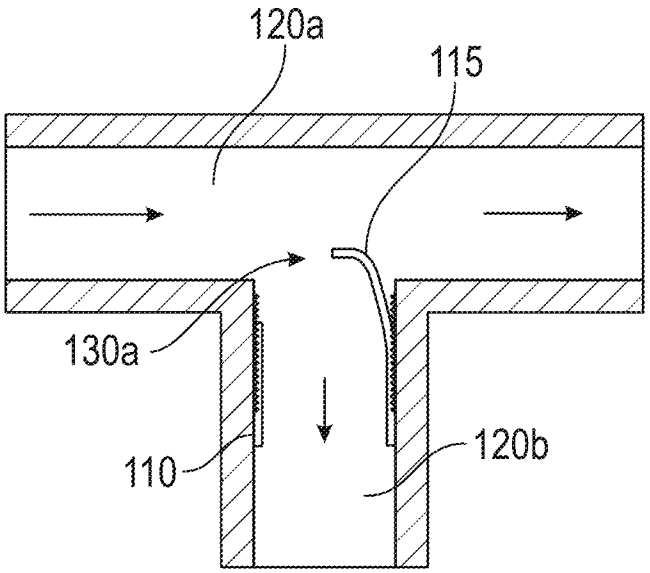
FIG. 3 is a cross-sectional view of a flow control insert within a pipe according to the exemplary embodiment shown in FIG. 2.

FIG. 3 is a cross-sectional view of a flow control insert 110 within a pipe 120*b* according to the exemplary embodiment shown in FIG. 2. The flow control insert 110 is shown threaded into a pipe 120*b* at a side-tee junction 130*a*, with the diverter 115 extending into the pipe 120*a*. This is similar to the scenario discussed with reference to FIG. 1. FIG. 4 shows the same flow control insert 110 and scenario as FIG. 3. The flow control insert 110 shown in FIG. 3 is positioned (i.e., threaded) such that the diverter 115 extends into the pipe 120*a* less than the diverter 115 shown in FIG. 4. As a result, the flow split between the pipes 120*a*, 120*b* at the side-tee junction 130*a* is greater according to the positioning of the flow control insert 110 shown in FIG. 4. That is, when the flow control insert 110 is positioned such that the diverter 115 extends further into the pipe 120*a*, as shown in FIG. 4, more of the agent 105 is diverted or split into the pipe 120*b*.

Figure 6:
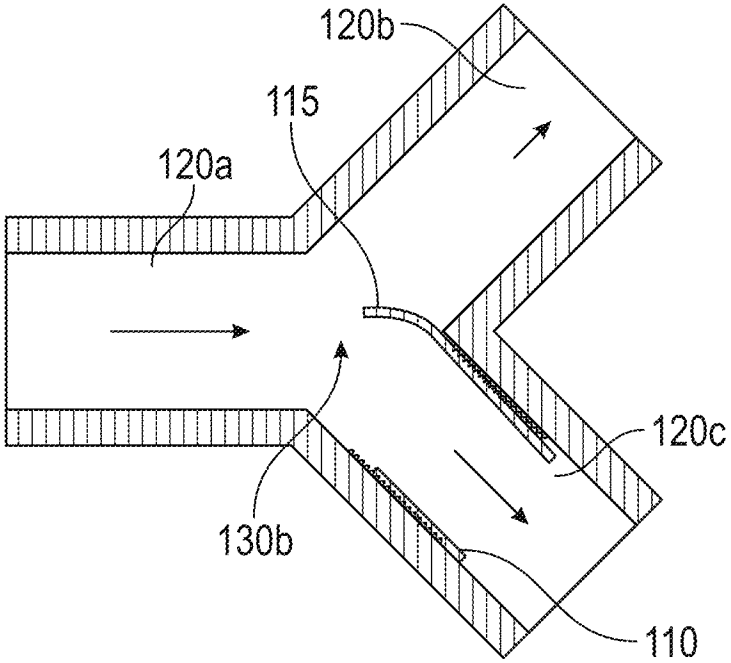
FIG. 6 is a cross-sectional view of the flow control insert shown in FIG. 5 in a different position.
Figure 5:
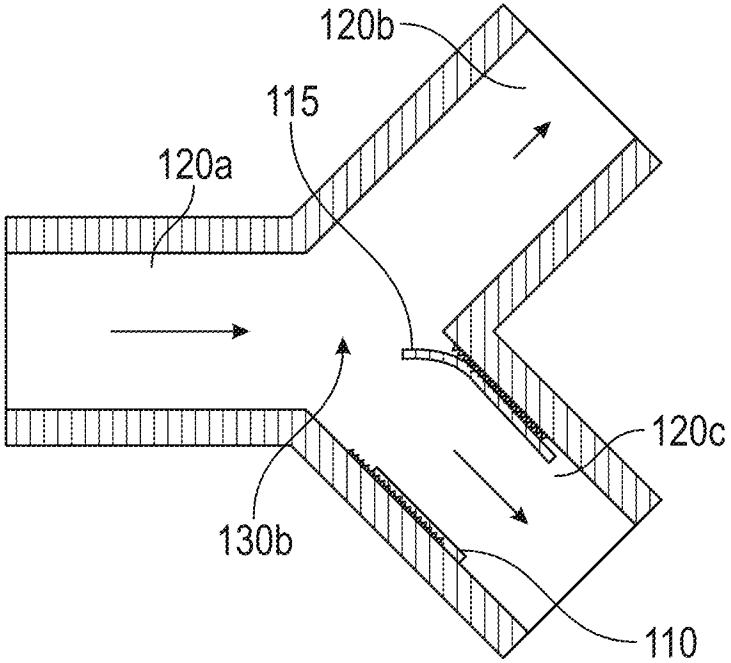
FIG. 5 is a cross-sectional view of a flow control insert within a pipe according to the exemplary embodiment shown in FIG. 2.

FIG. 5 is a cross-sectional view of a flow control insert 110 in a pipe 120*c* according to the exemplary embodiment shown in FIG. 2. The flow control insert 110 is shown threaded into a pipe 120*c* at a wye junction 130*b*, with a diverter 115 extending into the wye junction 130*b*. This is similar to the scenario discussed with reference to FIG. 1. FIG. 6 shows the same flow control insert 110 and scenario as FIG. 5. The flow control insert 110 shown in FIG. 5 is positioned (i.e., threaded) such that the diverter 115 extends into the wye junction 130*b* less than the diverter 115 shown in FIG. 6. As a result, the flow split between the pipes 120*b*, 120*c* at the wye junction 130*b* is greater according to the positioning of the flow control insert 110 shown in FIG. 6. That is, when the flow control insert 110 is positioned such that the diverter 115 extends further into the wye junction 130*b*, as shown in FIG. 6, more of the agent 105 is diverted or split into the pipe 120*c*.

Figure 7:
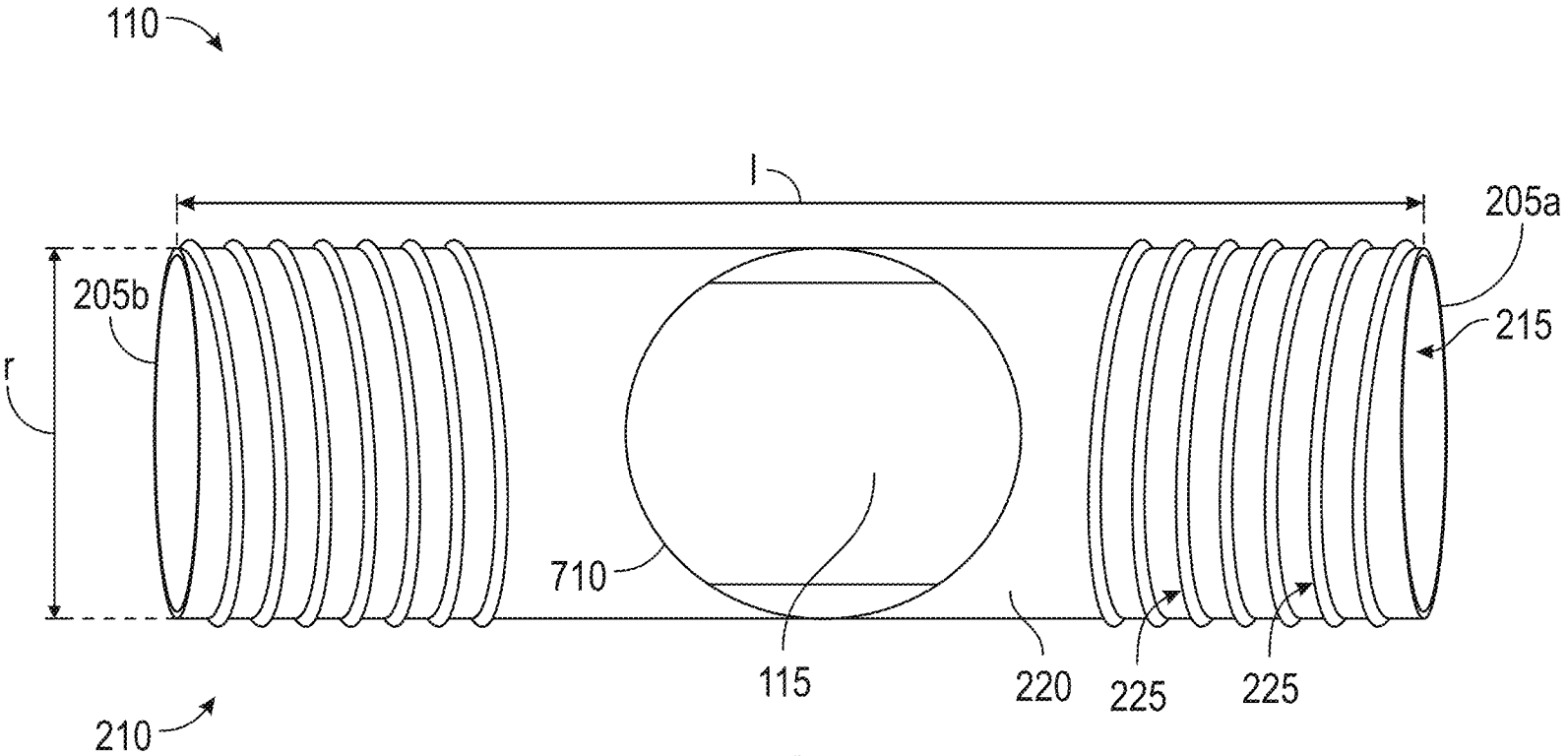
FIG. 7 shows a flow control insert according to one or more embodiments.

FIG. 7 shows a flow control insert 110 according to one or more embodiments. The exemplary embodiment shows the type of flow control insert 110*c* indicated at the bull tee junction 130*c* in FIG. 1. This type of flow control insert 110*c* may be used at any obtuse full-split junction 140*c*. Based on the angle at which flow splits, the flow control insert 110*c* may be formed as two or more pieces that are threaded separately at the obtuse full-split junction 140*c* but function together. Like the exemplary embodiment shown in FIG. 2, the flow control insert 110 shown in FIG. 7 has a main body 210 that has a hollow cylindrical shape with openings at two opposite ends 205*a*, 205*b*. The outer surface 220 includes threading 225. Unlike the embodiment shown in FIG. 2, the main body 210 includes a hole 710. According to the exemplary case shown in FIG. 1, the hole would accommodate pipe 120*a* while the threaded portions would affix the flow control insert 110 within pipes 120*e*, 120*f*. That is, threading 225 on one side of the hole 710 may be within pipe 120*e* (nearer the end 205*a*) while threading 225 on the other side of the hole 710 (nearer the end 205*b*) may be within pipe 120*f*. The diverter 115 is within the main body 210 and is partially visible through the hole 710. This is because the diverter 115 may extend from an inner surface 215 of the main body 210 opposite the hole 710. The diverter 115 is further discussed with reference to FIGS. 8 and 9.

Figure 8:
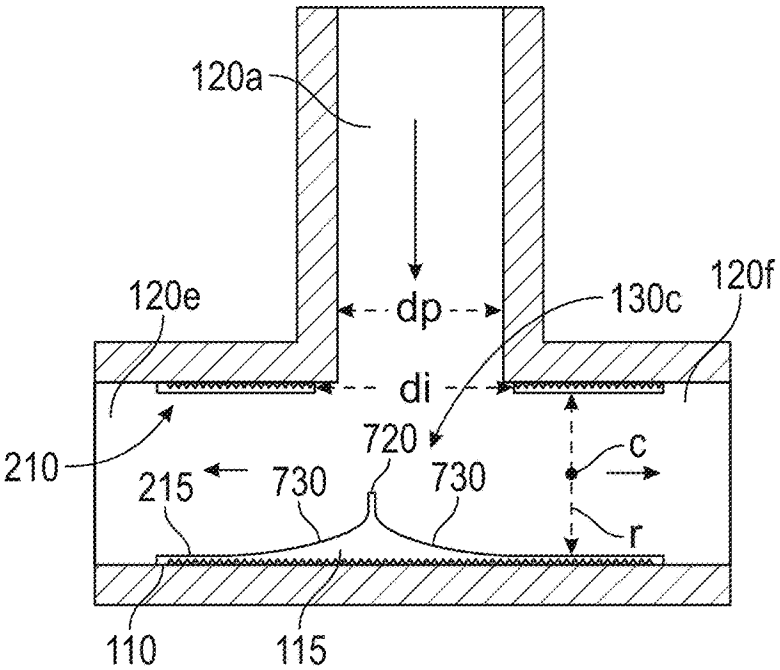
FIG. 8 is a cross-sectional view of a flow control insert within pipes according to the exemplary embodiment shown in FIG. 7.

FIG. 8 is a cross-sectional view of a flow control insert 110 in pipes 120*e*, 120*f* according to the exemplary embodiment shown in FIG. 7. For explanatory purposes, the labels used in FIG. 1 are reused. As such, flow from a pipe 120*a* is split into pipes 120*e*, 120*f* at a bull tee junction 130*c*. As noted in the discussion of FIG. 7 and visible in FIG. 8, the flow control insert 110 has a hole 710 in the main body 210 that accommodates the pipe 120*a*. That is, as shown in FIG. 8, the diameter di of the hole 710 is larger than the diameter dp of the pipe 120*a*. The radial length r and radial center c of the main body 210 of the flow control insert 110 are indicated. As also noted in the discussion of FIG. 7, the diverter 115 is within the main body 210 of the flow control insert 110, as opposed to extending from it as in the exemplary embodiment shown in FIG. 2, and is opposite the hole 710. In this way, the diverter 710 affects the flow split into the pipes 210*e*, 210*f* at the bull tee junction 130*c*.

Figure 9:
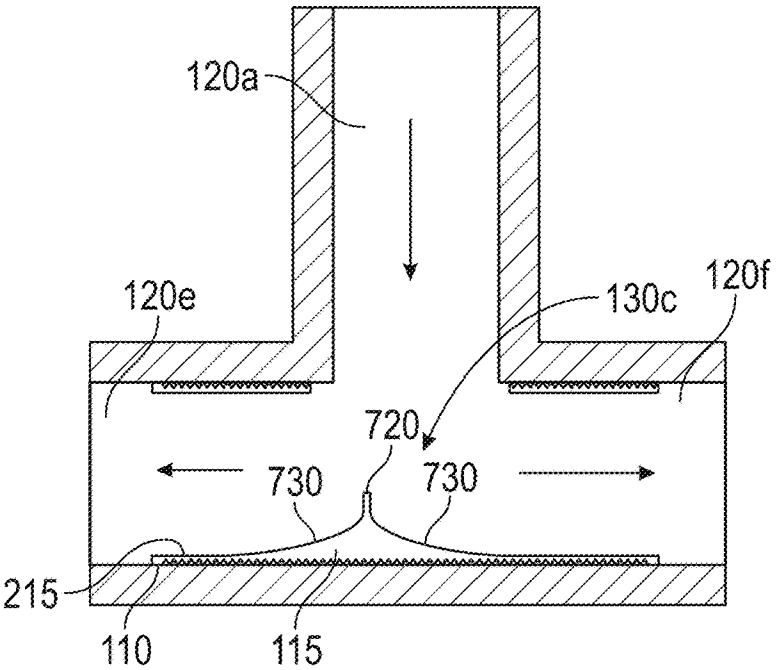
FIG. 9 is a cross-sectional view showing a different flow control insert according to the exemplary embodiment shown in FIG. 7.

Specifically, the diverter 115 has a center 720 that extends into the main body 210, closer to the radial center c of the main body 210 than any other portion of the diverter 115. In addition, the diverter 115 includes a slope 730 on each side of the center 720 of the diverter 115. Each slope 730 is from the center 720 of the diverter 115 to the inner surface 215 of the main body 210. The center 720 of the diverter 115 affects the mass split while the slopes 730 ensure that flow energy is not dissipated. FIG. 9 shows the same scenario as FIG. 8.

However, a different flow control insert 110 is used. The flow control insert 110 shown in FIG. 9 has a diverter 115 with a center 720 that is closer to pipe 120*e* than pipe 120*f* within the bull tee junction 130*c*, while the flow control insert 110 shown in FIG. 8 has a diverter 115 with a center 720 that is centered within the bull tee junction 130*c*. As a result, the mass split in the configuration of FIG. 8 is equal between pipes 120*e* and 120*f* In the configuration of FIG. 9, more of the agent 105 would be diverted to the pipe 120*f* rather than to pipe 120*e*. As previously noted, the result of concentration testing may be the basis for using the flow control insert 110 shown in FIG. 9 versus the one shown in FIG. 8. That is, if the concentration testing indicated that outlets 102 that are fed by pipe 120*f* have much lower concentrations of the agent 105 than outlets 102 that are fed by pipe 120*e*, then the flow control insert 110 shown in FIG. 9 may be used to divert more of the flow to the pipe 120*f*.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A flow control insert comprising:

a main body that is shaped as a cylinder, is hollow, and includes an opening at a first end and at a second end, opposite the first end, along an axial length of the cylinder, wherein an outer surface of the main body includes threading configured to screw into complementary threading on an inner surface of a pipe configured to flow an agent; and a diverter within the main body or extending from the first end of the main body, wherein the diverter is configured to control a mass split of the agent or flow energy of the agent flowing in the pipe;

wherein the main body includes a hole between the first end and the second end, and a longest portion of the hole extends over a range of axial positions along the axial length of the cylinder;

wherein the diverter is within the main body, the diverter extends from an inner surface of the main body, the diverter is located opposite the hole, and a center of the diverter is at a position that is within the range of axial positions along the axial length of the cylinder;

wherein the diverter is arranged and configured to divert the flow of the agent to both the first and second ends of the main body.

2. The flow control insert according to claim 1, wherein the diverter is shaped such that the center of the diverter is closer to a radial center of the main body than other portions of the diverter and the diverter includes a slope on both sides of the center of the diverter from the center of the diverter to the inner surface of the main body.

3. An agent distribution system comprising:

a network of pipes configured to facilitate a flow of the agent from an inlet to two or more outlets; and a flow control as recited in claim 1 installed in one of the pipes and the hole is arranged to receive the flow from an other one of the networks of pipes.

4. The agent distribution system according to claim 3, wherein the diverter is shaped such that the center of the diverter is closer to a radial center of the main body than other portions of the diverter and the diverter includes a slope on both sides of the center of the diverter from the center of the diverter to the inner surface of the main body.

5. The agent distribution system according to claim 4, wherein the network of pipes includes an obtuse full-split junction at which the flow of the agent in a first pipe is split into a second pipe and a third pipe, a first angle between the second pipe and the first pipe and a second angle between the third pipe and the first pipe being at least 90 degrees and less than 180 degrees, the flow control insert is configured to be threaded into the inner surface of the second pipe and the third pipe, and the hole in the main body of the flow control insert facilitates the flow of the agent from the first pipe into the obtuse full-split junction.

6. A method of fabricating a flow control insert, the method comprising:

fabricating a main body to be shaped as a cylinder, to be hollow, and to include an opening at a first end and at a second end, opposite the first end, along an axial length of the cylinder;

including threading on an outer surface of the main body, wherein the threading is configured to screw into complementary threading on an inner surface of a pipe configured to flow an agent; and forming a diverter within the main body or to extend from the first end of the main body, wherein the forming the diverter includes configuring the diverter to control a mass split of the agent or flow energy of the agent flowing in the pipe;

wherein the fabricating the main body includes forming a hole between the first end and the second end, a longest portion of the hole extending over a range of axial positions along the axial length of the cylinder;

wherein the forming the diverter includes locating the diverter within the main body, the diverter extending from an inner surface of the main body, locating the diverter opposite the hole along a radial length of the cylinder, and positioning a center of the diverter within the range of axial positions along the axial length of the cylinder;

wherein the diverter is formed and configured to divert the flow of the agent to both the first and second ends of the main body.

7. The method according to claim 6, wherein the forming the diverter includes shaping the diverter such that the center of the diverter is closer to a radial center of the main body than other portions of the diverter and including a slope on both sides of the center of the diverter from the center of the diverter to the inner surface of the main body.

* * * * *